US011684971B2

(12) United States Patent
Algueró Guasch

(10) Patent No.: US 11,684,971 B2
(45) Date of Patent: Jun. 27, 2023

(54) INJECTION CHAMBER OR CONTAINER

(71) Applicant: ALROTEC TECHNOLOGY, S.L.U., Constnati (ES)

(72) Inventor: Jordi Algueró Guasch, Constanti (ES)

(73) Assignee: ALROTEC TECHNOLOGY, S.L.U., Constanti (ES)

( * ) Notice: Subject to any disclaimer, the term of this patent is extended or adjusted under 35 U.S.C. 154(b) by 147 days.

(21) Appl. No.: 17/298,443

(22) PCT Filed: Nov. 29, 2019

(86) PCT No.: PCT/ES2019/070820
§ 371 (c)(1),
(2) Date: May 28, 2021

(87) PCT Pub. No.: WO2020/109645
PCT Pub. Date: Jun. 4, 2020

(65) Prior Publication Data

US 2022/0023937 A1 Jan. 27, 2022

(30) Foreign Application Priority Data

Nov. 29, 2018 (ES) ..... ES201831158

(51) Int. Cl.
*B22D 17/10* (2006.01)
*B22D 17/20* (2006.01)

(52) U.S. Cl.
CPC ..... *B22D 17/10* (2013.01); *B22D 17/2038* (2013.01)

(58) Field of Classification Search
CPC . B22D 17/10; B22D 17/2038; B22D 17/2023
See application file for complete search history.

(56) References Cited

U.S. PATENT DOCUMENTS 4,086,953 A 5/1978 Kraklau
5,322,111 A * 6/1994 Hansma ..... B22D 17/2023 164/312

(Continued)

FOREIGN PATENT DOCUMENTS

DE 2449428 A1 4/1976
EP 1338360 A2 8/2003

(Continued)

OTHER PUBLICATIONS

Int'l Search Report for PCT/ES2019/070820, dated Mar. 10, 2020.

*Primary Examiner* — Kevin P Kerns
*Assistant Examiner* — Steven S Ha
(74) *Attorney, Agent, or Firm* — MaxGoLaw PLLC

(57) ABSTRACT

An injection chamber or container for machines for pressure die-casting processes is provided, which is formed by a cylinder (1) includes an external cuff (2) and an internal insert (3), through which passes material that is introduced through an opening (4) and pressure-driven by means of a piston (5) into a mould (6). The internal insert (3) has an outer diameter (d) smaller than the inner diameter (D) of the external cuff (2), there being between the two diameters (d, D), a difference of dimension (a) such that the insert (3) can be inserted into and removed from the cuff (2) directly and cold, that is, without dilating it, and such that the only dilation that the insert undergoes (3), which is caused by the heat of the material to be extruded that passes therethrough when the cylinder (1) is operating, causes the insert to become fixed inside the cuff (2).

10 Claims, 6 Drawing Sheets

(56) References Cited

U.S. PATENT DOCUMENTS

| | | | | |
|---|---|---|---|---|
| 2014/0106994 | A1* | 4/2014 | Furukawa | C10M 125/02<br>508/126 |
| 2017/0008077 | A1* | 1/2017 | Uchida | B22D 13/02 |

FOREIGN PATENT DOCUMENTS

| | | | |
|---|---|---|---|
| ES | 2199771 | T3 | 3/2004 |
| JP | 2003136213 | A | 5/2003 |

* cited by examiner

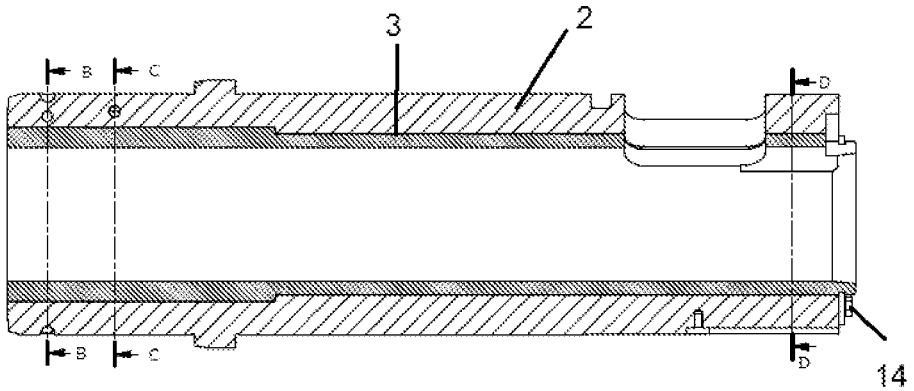
FIG. 7
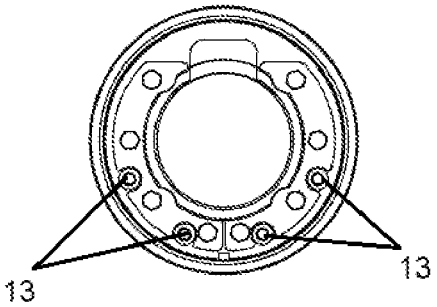
FIG. 8-A
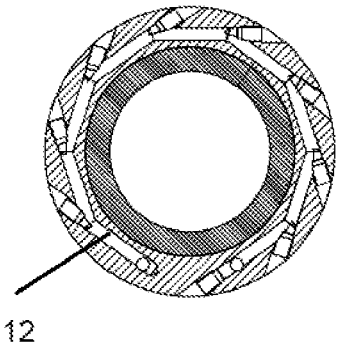
FIG. 8-B
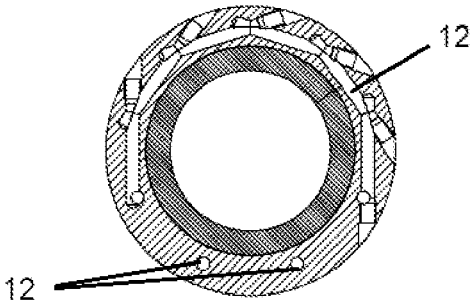
FIG. 8-C
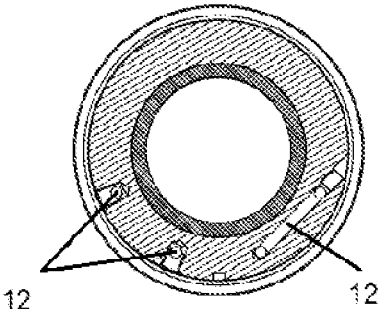
FIG. 8-D

INJECTION CHAMBER OR CONTAINER

OBJECT OF THE INVENTION

The invention, as expressed in the title of this specification refers to an injection chamber or container that provides to the function to which it is designed with advantages and characteristics, that are disclosed in detail thereafter, that mean an improvement to the current state-of-the-art.

The object of this invention refers, concretely to a hollow cylinder that constitutes the nozzle or container to inject material in the mold in processes of die casting which, comprising an external envelope or external cylindric body, that is always the same and an internal insert, or internal cylindric body, that is periodically replaced, possesses the feature that the said internal insert has externally, an external diameter smaller than the internal diameter of the internal wall of the external envelope allowing to cold placing it, and it is fixed to the said envelope simply when it expands with the heat of the material to be injected itself, simplifying thus as well its manufacture as the replacement method thereof compared with the systems used until now.

FIELD OF APPLICATION OF THE INVENTION

The field of application of this invention is within the sector of the industry engaged in the manufacture of apparatuses, devices y accessories for injection machines, particularly focusing in those designed to extrusion and pressure die casting systems, including concretely the scope of the cylinders or nozzles applicable for the said injection.

BACKGROUND OF THE INVENTION

Are well-known the injection chambers or containers of the type concerned herein, that means, applicable in processes of die casting or pressure die casting non-ferrous materials, generally metals such as aluminium and magnesium, and formed, as it has already been told, by a hollow assembly comprising a fixed external envelope, that is always the same, with an internal insert, through which the material is passed under pressure by means of a piston that pushes it by an end to the inside of the mold located at the opposite end, this internal insert being exchangeable in order to be able to replace it every time it becomes deteriorated.

Currently, those injection chambers or containers, normally, are formed so that the internal insert has an interference in the external diameter with the internal diameter of the external envelope and, in order to be able to introduce it within it, it is introduced with the external envelope heated so that it is dilated, and when the envelope cools down, and therefore is contracted, the internal insert is fixed to the external envelope wall.

An example of this type of cylinders is present in the document U.S. Pat. No. 9,862,025, that can be taken as the closest to the state-of-the-art of the object of this invention.

The problem of this system is that, every time the internal insert has to be repositioned it is necessary to heat again the envelope, but even so the extraction is complicated and expensive. In addition, to avoid the longitudinal relative movement between the internal insert and the external envelope, at least one additional part is used that acts as stop and anti-rotation device to the insert.

The objective of this invention therefore, is to develop an improved injection chamber or container allowing to avoid these problems and providing an alternative solution, simpler and more effective, as well to carry out the exchange of the internal insert as to its manufacture without stopping failing to provide the capacity of injection to which the chamber or container is designed.

On the other hand, and as reference to the current state-of-the-art, it shall be pointed out that the existence is not known of any other injection chamber or container or of any other invention having a similar application, possessing technical, structural and constitutive characteristics same or similar to those that the one herein claimed possesses.

EXPLANATION OF THE INVENTION

The injection chamber or container that the invention proposes is configurated as a practical solution to the said problems, the characterizing details that make it possible and that distinguish it duly appearing in the final claims attached to this description.

More concretely, what the invention proposes, as stated above, is an injection chamber or container for pressure injection of non-ferrous material in a mold in die casting processes which, comprising a fixed external envelope and an exchangeable internal insert, are distinguished in that the said internal insert is cold placed in the external envelope and is fixed to it simply when the material is injected when it expands with the cast material heat itself.

For this, the external diameter of the internal insert is smaller than the internal diameter of the external envelope to such extent that, on the one hand, the said insert can be introduced in the envelope without it is necessary to expand it and, in addition, on the other hand, when the cylinder is operating the heat of the material to be injected itself that passes though it and expand the insert provokes it is fixed within the envelope.

Still with the features of the cylinder of the invention, it shall be pointed out that to avoid the longitudinal relative movement between the internal insert and the external envelope, it is not contemplated to use any additional element that acts as stop because the insert/envelope assembly is directly supported with the mold of the part, its manufacture being thus simplified.

In addition, however, to secure that it is fixed between both parties of the cylinder, the existence of two parts has been provided that are radially introduced in grooves of the insert and are fixed to it by means of screws, acting as stop and anti-rotation with the envelope.

Last, it shall be stated that, preferably, the application of a layer of graphite grease between the insert and the envelope is contemplated to facilitate the introduction and extraction of the said insert in the said envelope.

The main advantage of the cylinder object of the invention is that the operator of the machine can easily replace the insert when it is worn. This is achieved thanks to the fact that it can be cold disassembled and simply taking the mold apart and unscrewing the parts placed in its grooves.

Optionally the disassembly is carried out with a tool to that effect. The said tool preferably is a piston modified so that it possesses at least a stop that pushes the insert out of the envelope when the piston is moving.

DESCRIPTION OF THE DRAWINGS

To complement the description that is being done and in order to assist to best understanding the characteristics of the invention, attached to this specification, as an integral part thereof, there is a drawing in which with illustration and not limiting purpose the following has been represented:

The FIG. 1. It shows a schematic view in perspective of an example of injection chamber or container, object of the invention, representing jointly the mold with which it is used and the piston of material injection, the parts and elements it comprises and the configuration and arrangement thereof can be seen;

Figure 2:
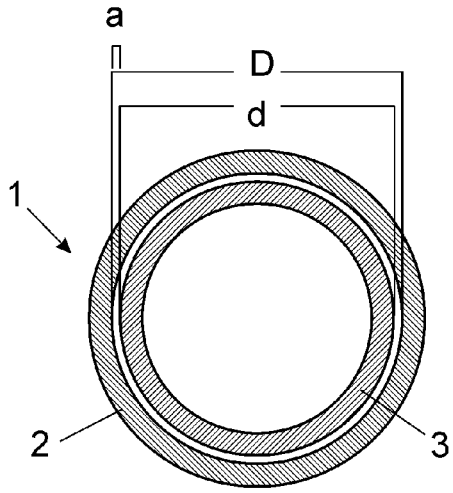
Figure 3:
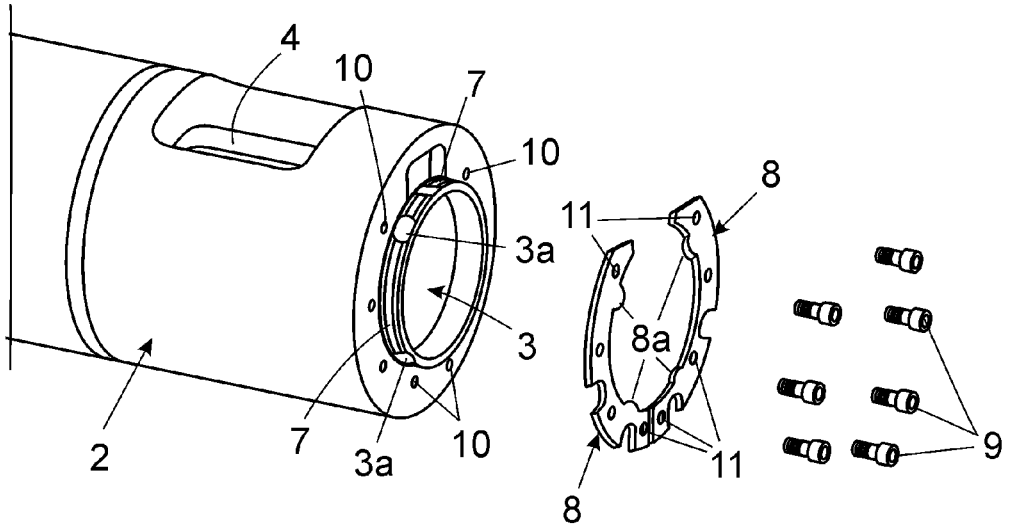
Figure 4:
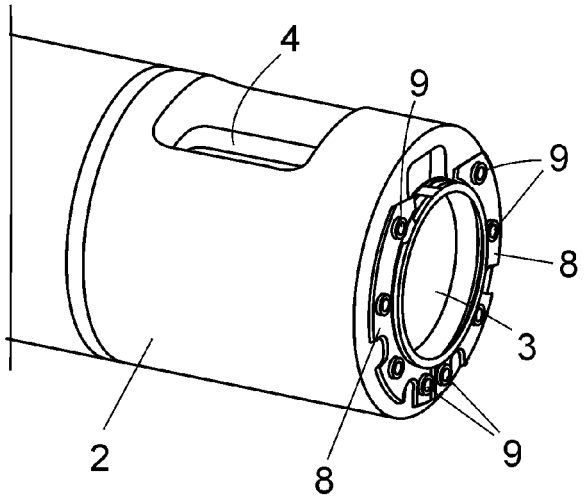
Figure 5A:
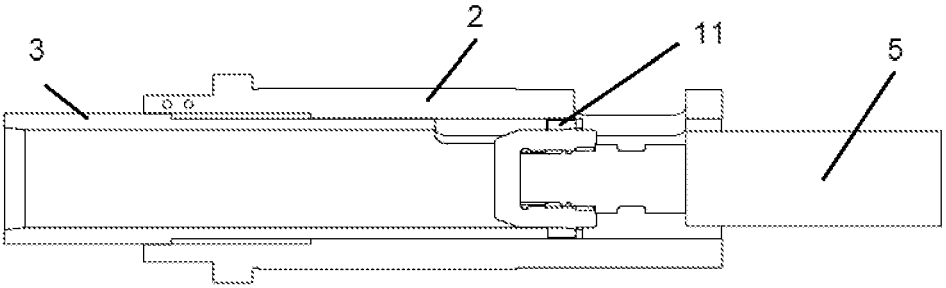

the FIG. 2. It shows a sectional schematic view of the injection chamber or container, according to the invention, the diameters ratio of the external envelope and of the internal insert that it comprises can be seen, which have been represented in exaggerated proportions to facilitate their appreciation;

the FIG. 3. It shows a schematic view in perspective of the enlarged detail of the end of the container of the invention, showing the said end exploded with the grooves of the insert, the retaining parts and the screws with which they are fixed;

the FIG. 4. It shows a view similar to that of the FIG. 3 of the end of the container, in this case with the retaining parts mounted, The FIG. 5A. It shows a section of the injection chamber or container, object of the invention with the piston with the stops in the head of the piston designed for extracting the insert from the envelope.

Figure 5B:
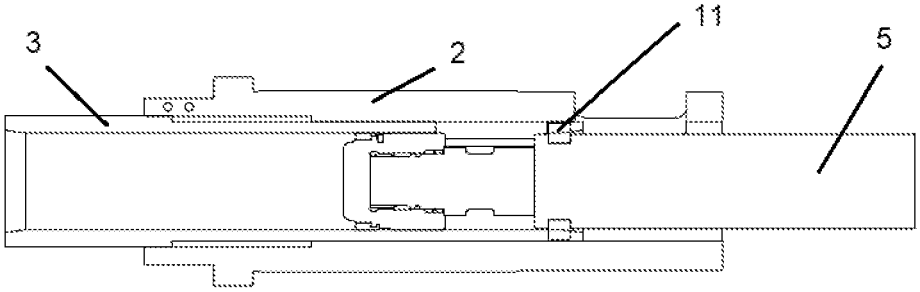

The FIG. 5B. It shows a section of the injection chamber or container, object of the invention with the piston with the stops in the piston-holder rod designed to extract the insert from the envelope.

Figure 6:
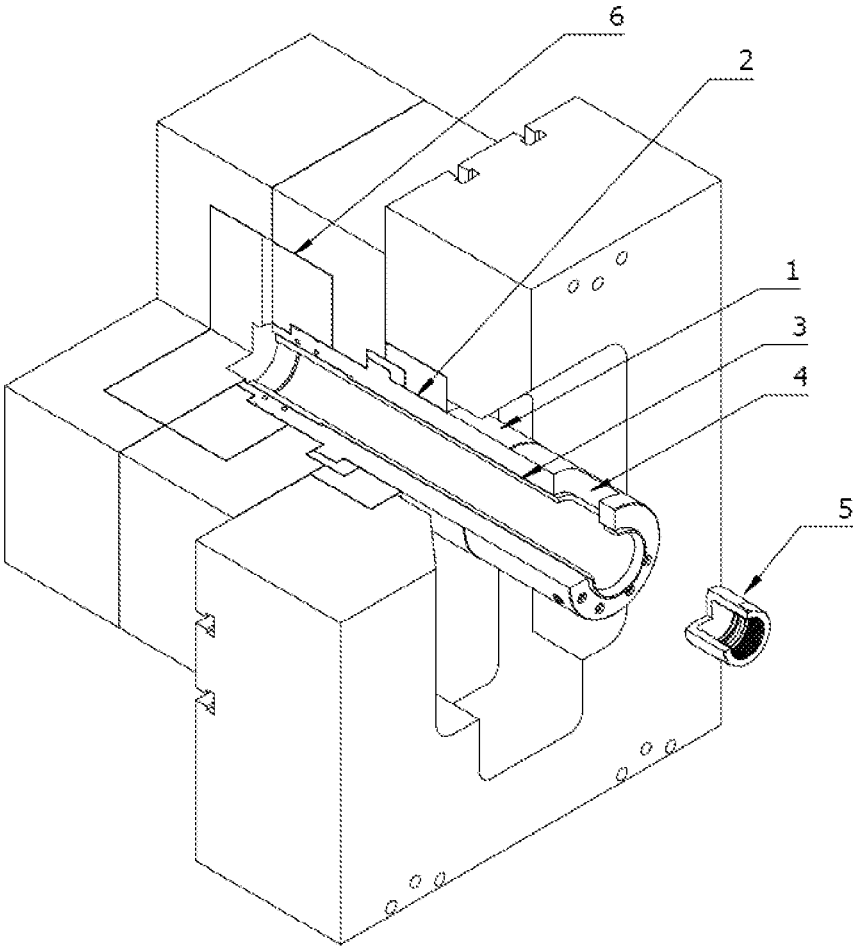

The FIG. 6. It shows another schematic view in perspective of an example of the injection chamber or container, object of the invention, representing jointly the mold with which it is used and the piston of injection of material, parts and elements it comprises and the configuration and arrangements thereof can be seen.

The FIG. 7. It shows a longitudinal section of the injection chamber or container, object of the invention where the cross sections of the FIGS. 8-A a 8-D are detailed The FIGS. 8-A a 8-D. They show different cross sections of the injection chamber or container where the cooling duct can be seen.

Figure 9:
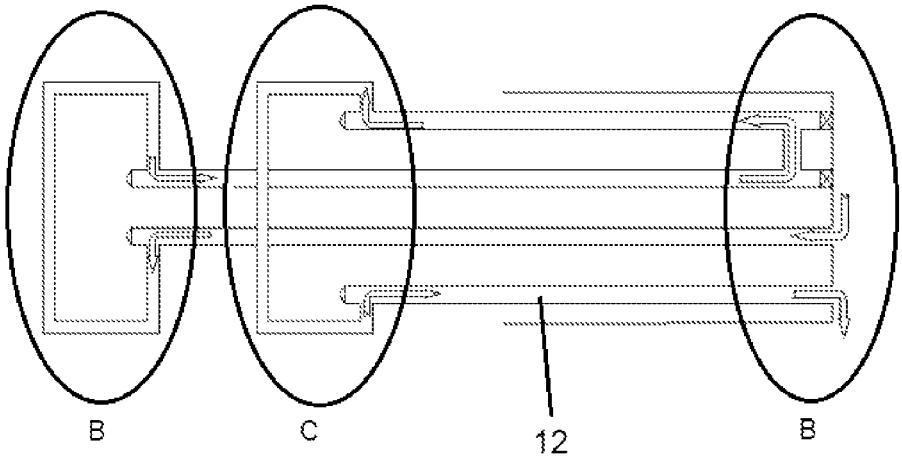

The FIG. 9. They shows the cooling circuit diagram where the different cooling area are detailed.

PREFERRED EMBODIMENT OF THE INVENTION

Seen the said figures, and according with the numerals adopted, it can be seen in them a not limiting example of embodiment of the injection chamber or container preconized, which comprises the parts and elements that are stated and disclosed in detail below.

Figure 1:
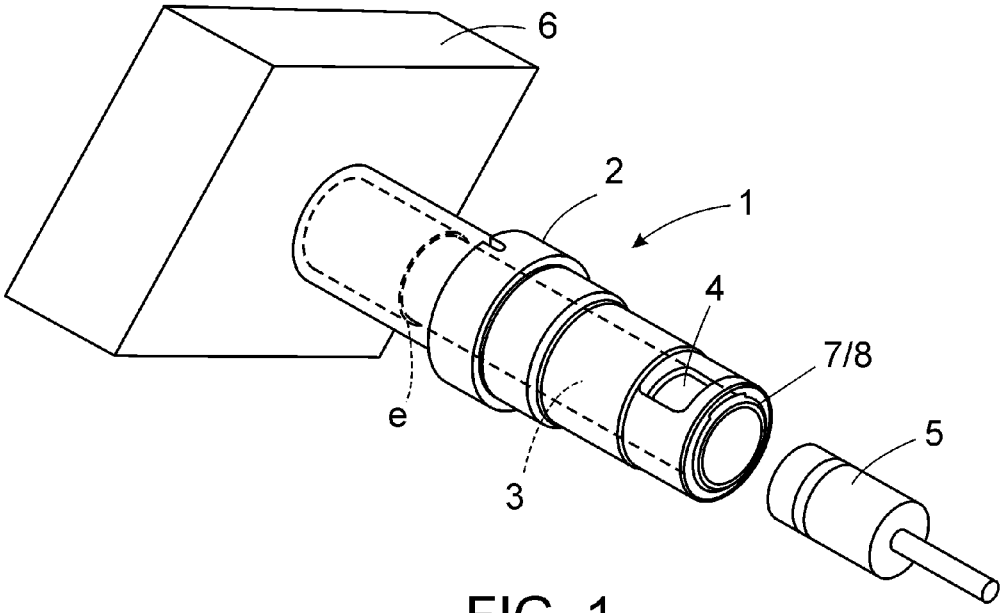

Thus, as it is observed in the FIG. 1, the injection chamber or container in question is a cylinder (1), applicable for its incorporation in machines for hot pressure die casting processes of non-ferrous materials, that is configurated, in a known manner, from an assembly comprising an external envelope (2), consisting in a hollow cylindric body and an internal insert (3), that can be incorporated in an extractable manner within the envelope (2) and it consists in a second hollow cylindric body that is longer than the envelope (2), through which the material is passed under pressure, introduced through an opening (4) and pushed by means of a piston (5), from an end of the cylinder (1) to a mold (6) located at the opposite end.

And, from this already known configuration the cylinder (1) is distinguished by the fact that the internal insert (3) has an external diameter (d) that is smaller than the internal diameter (D) of the external envelope (2), between both diameters (d, D) a difference of size (a) existing so that it allows the introduction and extraction of the said insert (3) in the envelope (2) directly and cold, that means, without it is necessary to expand it, and that the sole expansion the said insert (3) sustains, by the heat of the material to be extruded that passes through it when the cylinder (1) is operating, reduces to zero the said difference of size (a) provoking its fixing within the envelope (2).

In addition, in an option of embodiment, to avoid the longitudinal relative movement between the internal insert (3) and the external envelope (2) the use of any additional element is not contemplated that acts as stop and the insert/envelope assembly (3,2) of the cylinder (1) is directly supported on the mold (6).

In addition, the cylinder (1) preferably possesses, grooves (7) in the insert (3) for radially inserting retaining parts (8) that are fixed to it with screws (9) and that act as stops in the envelope (2), securing the fixation between both of them. Preferably the said parts possess protrusions (8*a*) that are introduced in slots (3*a*) of the insert (3) preventing the rotation between the insert (3) and the envelope (2). The said rotation could cause an unsuitable position of the opening (4) in the insert (3) and the envelope (2).

More concretely, as it can be seen in the FIGS. 3 and 4, the said grooves (7) of the insert (3) are determined by both recesses that are perimetrically located on both sides of the external surface of its end, in a small stretch that protrudes externally to the envelope (2) by the opposite side on which the mold (6) is supported, and the retaining parts (8) are formed by both sectors of circumference that are adjusted to the said grooves (7) remaining coupled on the rim of the envelope (3), on which surface a series of screwed holes (10) have been pierced that are coincident with the boreholes (11) provided in the said parts (8) for the passage of the screws (9) screwing in the said holes (10).

In addition, preferably, between the external surface of the insert (3) and the internal surface of the envelope (2), the cylinder (1) possesses a variation of diameter (d, D), concretely so that the said diameter (d, D) in both surfaces is larger at the end of the cylinder (1) that is supported on the mold (6) than in the opposite end, which, maintaining anyway the difference of size (a), has the aim of preventing that the insert (3) can be taken out of the envelope (2) by the wrong side, that means, by the side in which the piston (5) is introduced or in the direction opposite to the injection. Preferably the insert (3) and the envelope (2), have the same length.

In order to take the insert (3) out of the envelope (2) a piston (5) can be used designed to that effect that incorporates stops (11) that pushes the insert (3) out of the envelope (2). The said stops can be in the head of the piston as well as in the piston holder rod.

In the example appearing in the FIG. 1 the said variation of diameter (d, D) can be seen by the presence of a step (e), as it consists of a sharp variation without discarding it could be progressive.

Last, preferably, between the insert (3) and the envelope (2) a layer is incorporated (not represented) of graphite grease to facilitate the introduction and extraction of the said insert (3) in and out of the envelope (2).

In order to cool the envelope (2) that acquires the heat coming from the insert (3) that is in contact with the cast metal, the envelope (2) comprises a cooling system that comprises two areas having a cooling different degree; a first cooling area where the cooling area is limited to the lower part of the envelope (2), that means the opposite part of the opening (4), and a second cooling area located close to the mold (6) where the cooled part comprises cooling the envelope (2) full circumference The cast material when it is introduced through the opening (4) basically contacts the lower part of the insert (3) and therefore it is the lower part of the envelope (2) that is heated. The first cooling area is designed to remove the said heat.

When the cast material is pushed by the piston (5) towards the mold (6), the material contacts the full internal surface of the insert (3) located closest to the mold (6), that means that it warms the full circumference of the insert (3) and therefore it is the full circumference of the envelope (2) that is heated. The second cooling area is designed to remove the said heat. The second cooling area can be seen in the FIG. 8-B.

In a preferred embodiment, the different cooling areas share a duct (12) through which a cooling liquid flows.

As it can be seen in the FIG. 9, in an embodiment the duct (12) through which the cooling liquid flows on a longitudinal path from the farthest part of the mold (D) to the closest part of the mold (B) where the circuit has a semi-circular shaped path through the envelope (2) until coming back to the lower part of the envelope where it has a longitudinal path from the part closest of the mold (B) to the part farthest to the mold (D).

With this geometry, the first cooling area comprises the longitudinal stretches that go from the farthest part of the mold (D) (represented in the FIG. 8-D) to the closest part to the mold (B) (represented in the FIG. 8-B). The second cooling area comprises the semi-circular shaped stretch within the envelope (2) located at the closest part to the mold (B). The second cooling area can be seen in the FIG. 8-B.

Optionally, and in order to increase the length of the second cooling area as well as the the cooling power, of the first cooling area, the duct (12) through which the cooling liquid circulates has a second longitudinal path from the farthest part of the mold (D) to an intermediate part of the envelope (C) (represented in the FIG. 8-C), where the circuit has a semi-circular-shaped path within the envelope (2) until coming back to the lower part of the envelope where it has a longitudinal path from the intermediate part of the envelope (C) to the farthest part of the mold (D). The extension of the length of the second cooling area can be seen in the FIG. 8-C.

Preferably and in order to facilitate the manufacture of the duct (12) through which the cooling liquid flows, it is formed by cylindric holes (13) pierced in the envelope (2), some of them plugged up by means of plugs (14) in order to avoid that the cooling liquid goes out through the ends of the said holes. For example, the longitudinal stretches from the farthest part of the mold (D) to the closest part to the mold (B) or to the intermediate part of the mold (C) are from the end of the envelope as it can be seen in the FIG. 8-A. In the case of the semi-circular-shaped stretch, it is formed for example by the conjunction of different straight stretches as it can be seen in the FIG. 8-B or 8-C.

The insert is the part that sustains more expansion of the injection chamber or container assembly as it is the one in direct contact with the cast material. This problem worsens in the case where the insert (3) has to become more expanded than the envelope (2) to provoke the fixation of both elements. In this sense it is of interest that the insert (3) can sustain the greatest expansions without it is broken.

Generally, the manufacture of the inserts (3) by the mechanization of bar metal parts. The mechanization of bar metal parts in order to convert them in an insert (3) provokes that the insert (3) loses part of its strength.

For this reason, the applicant proposes that the insert (3) is manufactured by the centrifugation method. The centrifugation method allows a best distribution of the fibers and as it has not to be so mechanized compared with the method starting from a metal bar, the resulting insert (3) possesses a greater strength.

Sufficiently disclosed the nature of this invention, as well as the manner to implement it, it is not deemed necessary to extend any longer its explanation in order that a person skilled in the art understands its extent and the advantages arising from it, and it is pointed out that, within its essence, the invention can be implemented in other embodiments that differ in detail of that stated for example purpose, and to which shall also extend the protection that is sought provided that its main principle is not altered, changed or modified.

The invention claimed is:

1. An injection chamber or container that, applicable to be incorporated in machines for pressure die casting of non-ferrous materials and consisting in a cylinder (1) formed from an assembly that comprises an external envelope (2) and an internal insert (3) through which a material is passed under pressure through an opening (4) and pushed by means of a piston (5) from one end of the cylinder (1) to inside a mold (6) located at an opposite end, characterized in that an external diameter (d) of the internal insert (3) is smaller than an internal diameter (D) of the external envelope (2), between both diameters (d, D) a difference of size (a) existing so that it allows an introduction and extraction of the insert (3) in the envelope (2) directly without expanding it, and that a sole expansion the insert (3) sustains, by a heat of the material to be injected that passes through it when the cylinder (1) is operating, reduces to zero the difference of size (a) provoking its fixation within the envelope (2), wherein the envelope (2) comprises a cooling system that comprises two areas having a different degree of cooling; a first cooling area limited to a lower part of the envelope (2) distal to the mold, that means the part opposite to the opening (4), and a second cooling area located proximal to the mold (6) where the second cooling area comprises cooling the full circumference of the envelope (2), characterized in that the insert (3) possesses grooves (7) for radially inserting retaining parts (8) that are fixed to it with screws (9), acting as stop in the envelope (2), wherein the grooves (7) are recesses of an external surface of the end of the insert (3), in stretches that protrude externally to the envelope (2), and the retaining parts (8) are formed by both sectors of circumference that are adjusted to the grooves (7) remaining coupled on a rim of the envelope (3), on which surface screwed holes (10) have been pierced coincident with boreholes (11) provided in the parts (8) for the passage of the screws (9), and wherein the retaining parts (8) possess protrusions (8*a*) that are introduced in slots (3*a*) of the insert (3) preventing a rotation between the insert (3) and the envelope (2).

2. The injection chamber or container, according to claim 1, characterized in that the different cooling areas share a duct (12) through which a cooling liquid flows.

3. The injection chamber or container, according to claim 2, characterized in that the duct (12) through which the cooling liquid flows has a longitudinal path from a farthest part of the mold (D) to a closest part of the mold (B) where a circuit is semi-circular-shaped within the envelope (2) until coming back to the lower part of the envelope where it has a longitudinal path from the closest part to the mold (B) until the farthest part of the mold (D).

4. The injection chamber or container, according to claim 3, characterized in that the duct (12) through which the cooling liquid flows has a second longitudinal path from the farthest part of the mold (D) to an intermediate part of the envelope (C) where a second circuit has a semi-circular-shaped path within the envelope (2) until coming back to the lower part of the envelope where it has a longitudinal path from the intermediate part of the envelope (C) to the farthest part of the mold (D).

5. The injection chamber or container, according to claim 3, characterized in that the duct (12) through which the cooling liquid flows is formed by holes (13) pierced in the envelope (2), some of them plugged up by means of plugs (14) in order to avoid that the cooling liquid goes out through an end of the holes.

6. The injection chamber or container, according to claim 1, characterized in that, between the insert (3) and the envelope (2), they have the same length.

7. The injection chamber or container, according to claim 1 characterized in that the insert/envelope assembly (3,2) of the cylinder (1) is directly supported on the mold (6), avoiding a longitudinal relative movement between the internal insert (3) and the external envelope (2) without any additional element acting as stop.

8. The injection chamber or container, according to claim 1, characterized in that, between the insert (3) and the envelope (2) a layer is incorporated of graphite grease to facilitate the introduction and extraction of the insert (3) in and out of the envelope (2).

9. The injection chamber or container, according to claim 1, characterized in that, between an external surface of the insert (3) and an internal surface of the envelope (2), it possesses a variation of diameter that locks the insert (3) in a direction opposite to the injection.

10. A method of manufacture of an insert (3) applicable in an injection chamber or container as disclosed in claim 1, characterized in that it is manufactured by centrifugal casting.

* * * * *